US011168894B2

(12) United States Patent
Sager

(10) Patent No.: US 11,168,894 B2
(45) Date of Patent: Nov. 9, 2021

(54) COMBINATION COOKING OVEN WITH OPERATOR FRIENDLY HUMIDITY CONTROL

(75) Inventor: David D. Sager, Troy, OH (US)

(73) Assignee: PREMARK FEG L.L.C., Wilmington, DE (US)

( * ) Notice: Subject to any disclaimer, the term of this patent is extended or adjusted under 35 U.S.C. 154(b) by 1130 days.

(21) Appl. No.: 13/472,774

(22) Filed: May 16, 2012

(65) Prior Publication Data

US 2012/0294992 A1 Nov. 22, 2012

Related U.S. Application Data

(60) Provisional application No. 61/488,621, filed on May 20, 2011.

(51) Int. Cl.

| | |
|---|---|
| ***A47J 27/62*** | (2006.01) |
| ***F24C 15/32*** | (2006.01) |
| ***F24C 7/08*** | (2006.01) |

(52) U.S. Cl.

CPC ..... *F24C 15/327* (2013.01); *F24C 7/08* (2013.01)

(58) Field of Classification Search

CPC ..... A01B 12/006; A24C 15/327; F24C 7/08
USPC ..... 426/231; 126/21 A; 219/400, 401
See application file for complete search history.

(56) References Cited

U.S. PATENT DOCUMENTS

| | | | | |
|---|---|---|---|---|
| 4,709,685 | A | 10/1987 | Miller | |
| 4,817,582 | A | 4/1989 | Oslin et al. | |
| 4,851,644 | A | 7/1989 | Oslin | |
| 4,920,948 | A * | 5/1990 | Koether et al. | 126/21 A |
| 4,924,072 | A * | 5/1990 | Oslin | A47J 27/04 219/400 |
| 5,014,679 | A | 5/1991 | Childs et al. | |
| 5,619,983 | A | 4/1997 | Smith | |
| 5,951,901 | A | 9/1999 | Douglas et al. | |
| 6,555,791 | B2 * | 4/2003 | Lubrina et al. | 219/400 |
| 6,987,246 | B2 | 1/2006 | Hansen et al. | |

(Continued)

FOREIGN PATENT DOCUMENTS

| | | | |
|---|---|---|---|
| DE | 20002833 | U1 | 6/2000 |
| DE | 202007010358 | U1 | 9/2007 |

(Continued)

OTHER PUBLICATIONS

PCT/US2012/038246, Notification of Transmittal of the International Search Report and Written Opinion of the International Searching Authority or the Declaration, dated Oct. 30, 2012; 6 pgs.

(Continued)

*Primary Examiner* — Steven N Leff
(74) *Attorney, Agent, or Firm* — Thompson Hine LLP

(57) ABSTRACT

A combination oven includes a cooking cavity accessible via a door, a convection cooking system associated with the cooking cavity for heating the cooking cavity and a moisture delivery arrangement for delivering moisture into the cooking cavity. A controller is configured to (i) control the convection cooking system for a cooking operation in accordance with an operator selected temperature for the cooking operation and (ii) automatically define a humidity level setting for the cooking operation as a function of the operator selected temperature. An oven may also include an automated vent operation.

15 Claims, 4 Drawing Sheets

(56) References Cited

U.S. PATENT DOCUMENTS

| | | | | |
|---|---|---|---|---|
| 7,060,941 | B1 * | 6/2006 | Embury | F24C 15/327 219/401 |
| 7,208,701 | B2 * | 4/2007 | Fraccon | F24C 15/327 126/510 |
| 2003/0141296 | A1 | 7/2003 | Thorneywork | |
| 2004/0261632 | A1 * | 12/2004 | Hansen et al. | 99/468 |
| 2008/0237213 | A1 * | 10/2008 | Bujeau | A21B 3/04 219/401 |
| 2009/0218332 | A1 | 9/2009 | Negandhi et al. | |

FOREIGN PATENT DOCUMENTS

| | | | |
|---|---|---|---|
| DE | 102007043371 | A1 | 4/2009 |
| DE | 102008036683 | | 2/2010 |
| JP | 201127273 | | 2/2011 |
| KR | 20070105799 | | 10/2007 |
| WO | WO 2007/103958 | A2 | 9/2007 |
| WO | WO 2007/103958 | A3 | 9/2007 |
| WO | WO 2011/031958 | | 3/2011 |

OTHER PUBLICATIONS

PCT US2012-038246, Written Opinion of the International Searching Authority, dated Oct. 30, 2012; 7 pgs.

* cited by examiner

COMBINATION COOKING OVEN WITH OPERATOR FRIENDLY HUMIDITY CONTROL

CROSS-REFERENCE

This application claims the benefit of U.S. Provisional Ser. No. 61/488,621, filed May 20, 2011, the entirety of which is hereby incorporated by reference.

TECHNICAL FIELD

This application relates generally to combination ovens that utilize multiple cooking technologies (e.g., convection and steam or convection, steam and microwave) to transfer heat to food products, and more particularly, to a combination oven that eliminates the need for a user to define a humidity setting.

BACKGROUND

Foodstuffs are cooked traditionally by applying thermal energy for a given time. In conventional ovens, foodstuffs are cooked by heat radiated from the oven cavity walls or by a nearby heat source to the surface of the foodstuff, or by natural convection. In convection ovens, heat energy is transferred to the surface of foodstuffs by convection from heated air moving through the oven cavity and over the surface of the foodstuff. In microwave ovens heat is transferred by absorption of microwave energy directly into the mass of foodstuffs. In steamers heat is transferred by steam condensing on the surface of the foodstuff.

In combination ovens more than one heat transfer process is used for the purpose of decreasing cooking time or to improve the taste, texture, moisture content or the visual, appeal of the cooked foodstuff. In a combination steam and convection mode moisture is delivered into the oven during cooking. Typical combination ovens include complex controls that require the user to either manually set desired humidity level directly or as part of a cooking program (e.g., recipe) set-up. Users tend to avoid the complex, and therefore many combination ovens are not utilized to full advantage and are simply operated as convection ovens or steamers at substantially all times. What is needed is a control that will enable users to easily take advantage of temperature and humidity setting.

SUMMARY

In one aspect, a combination oven includes a cooking cavity accessible via a door, a convection cooking system associated with the cooking cavity and a moisture delivery arrangement for delivering moisture into the cooking cavity. A controller is programmed or otherwise configured for (i) controlling the convection cooking system for a cooking operation in accordance with a selected temperature for the cooking operation, (ii) automatically defining a humidity level setting for the cooking operation according to the selected temperature and (iii) controlling the moisture delivery arrangement during the cooking operation to achieve the humidity level setting in the cooking cavity.

The combination oven of the preceding paragraph may further include a vent intake arrangement for delivering ambient air into the cooking cavity and an exhaust arrangement for exhausting air from the cooking cavity. The controller is programmed to control the vent intake and exhaust arrangement, in combination with the moisture delivery intake arrangement, to achieve the set humidity level in the cooking cavity.

The combination oven of either of the two preceding paragraphs may further include a humidity level monitoring arrangement associated with the cooking cavity for determining humidity level within the cooking cavity, the humidity level monitoring arrangement including at least one sensor operatively connected with the controller.

In the combination oven of any of the three preceding paragraphs, the controller may include associated memory storing at least one temperature-humidity profile that is accessed to define the humidity level.

In the combination oven of any of the four preceding paragraphs, multiple temperature-humidity profiles may be stored in memory. The controller may be programmed to enable one of the temperature-humidity profiles to be selected as an active temperature-humidity profile that will be accessed for the purpose of defining the humidity level.

The combination oven of any of the five preceding paragraphs may include an oven control interface having an input for selecting temperature, a display for displaying the selected temperature and a display for displaying the defined humidity level.

In the combination oven of any of the six preceding paragraphs, the oven control interface may further include an input for manually adjusting humidity level to permit user variance of the defined humidity level setting.

In another aspect, a combination oven includes a cooking cavity accessible via a door, a convection cooking system associated with the cooking cavity for heating the cooking cavity and a moisture delivery arrangement for delivering moisture into the cooking cavity. A controller is configured to (i) control the convection cooking system for a cooking operation in accordance with an operator selected temperature for the cooking operation and (ii) automatically define a humidity level setting for the cooking operation as a function of the operator selected temperature.

In a further aspect, a combination oven includes a cooking cavity accessible via a door, a convection cooking system associated with the cooking cavity for heating the cooking cavity and a moisture delivery arrangement for delivering moisture into the cooking cavity. An oven control interface includes an input for selecting a temperature for the cooking operation and a display for displaying the selected temperature. A controller is configured to control the convection cooking system for a cooking operation in accordance with an operator selected temperature for the cooking operation, wherein the controller is configured with a customize mode by which the discrete temperatures to be made available for operator selection can be varied.

In still another aspect, a combination oven includes a cooking cavity accessible via a door, a convection cooking system associated with the cooking cavity for heating the cooking cavity, a moisture delivery arrangement for delivering moisture into the cooking cavity and a vent intake and exhaust arrangement for exhausting air from the cooking cavity while drawing in ambient air. A controller is configured to: (i) control the convection cooking system for a cooking operation, (ii) control the moisture delivery arrangement and the vent intake and exhaust arrangement in accordance with a humidity level defined for the cooking operation, and (iii) automatically carry out a cavity vent operation at the end of the cooking operation, the controller configured such that during the cavity vent operation the controller will (a) control the moisture delivery arrangement to cease addition of steam or moisture and (b) turn on the vent intake and exhaust arrangement to exhaust moist air from the oven while drawing in ambient air.

The details of one or more embodiments are set forth in the accompanying drawings and the description below. Other features, objects, and advantages will be apparent from the description and drawings, and from the claims.

DETAILED DESCRIPTION

Figure 1:
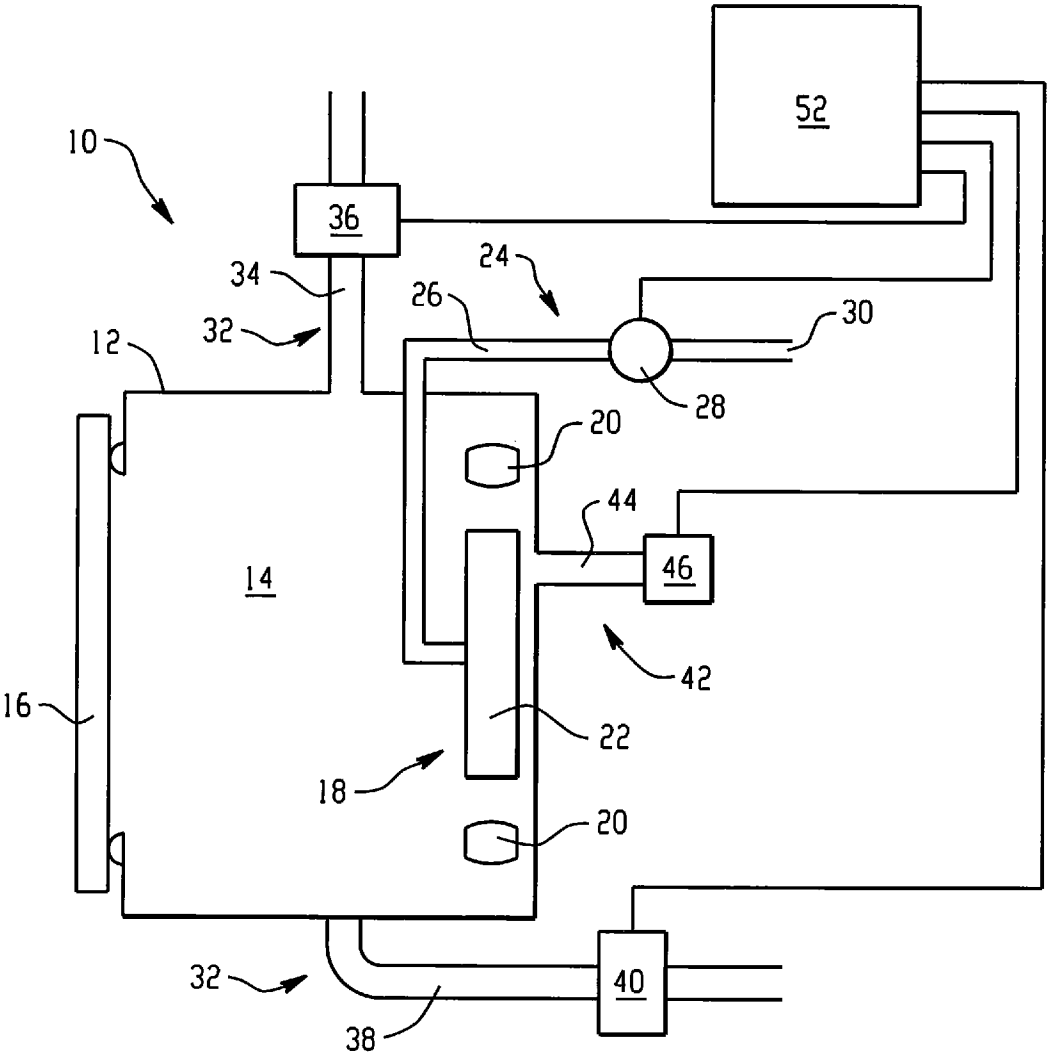
FIG. 1 is schematic showing a combination oven embodiment.

Referring to FIG. 1, a schematic depiction of a basic combination oven construction 10 is shown including a housing 12 defining a cooking cavity 14 that is accessible via an oven door 16 that movable between open and closed positions. A convection cooking system 18 may be formed by heating source member(s) 20 disposed about or alongside a circulation fan 22. The members 20 could, for example, be resistive heating elements or heat exchange tubes through which hot combustion gases pass. While in the illustrated embodiment the heating source members and fan are located along a back wall of the oven cavity, it is recognized that variations are possible. For example, the heating source members and fan could be located along a top, bottom or side wall, one or both of the heating source members and/or the fan could be located external of the cooking cavity itself (with air flow passages for delivering air into and out of the cavity from the location of the fan and/or heating source members) or the heating source members could be arranged in front of our behind the fan. U.S. Pat. No. 7,875,834, which is incorporated herein by reference, discloses various additional potential embodiments for convection cooking systems in an oven.

A moisture delivery arrangement 24 made up of passage 26 and control valve 28 are provided for delivering moisture into the cooking cavity. By way of example, the input 30 of the arrangement could be connected to a liquid water source (e.g., facility water) or a steam source (e.g., a steam generator). In the former case, the liquid water is converted to steam or liquid vapor when the fan 22 causes the water to impinge upon the heating source. In an alternative embodiment, the oven could include a sump or other location within the cooking cavity where water may be heated directly to produce steam. In such an embodiment, the water could be drained from the sump for cooking operations where no humidity is desired. U.S. Pat. No. 7,875,834 discloses various additional potential embodiments for arrangements to deliver moisture into an oven cooking cavity.

The combination oven also includes a vent intake and exhaust arrangement 32 formed by passage 34 and vent intake mechanism 36 for delivering air into the cooking cavity 14 and drain exhaust path 38 and exhaust mechanism 40 for delivering air out of the cavity 14. The vent intake mechanism 36 could take on a variety of forms such as a shutter mechanism and/or fan or a more complex device such as the air admission system described in U.S. Pat. No. 7,875,834 (e.g., the input, admission duct and regulation chamber). Likewise, the exhaust mechanism 40 could take on a variety of forms such as a shutter mechanism and/or fan or a more complex device such as the exhaust arrangement described on U.S. Pat. No. 7,875,834 (e.g., the described opening, evacuation duct, evacuation chamber and chimney).

Figure 2:
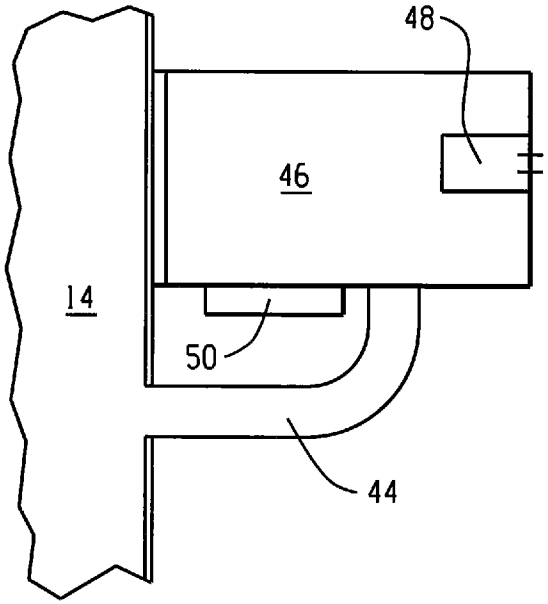
FIG. 2 is a partial schematic showing one embodiment of a humidity sensing arrangement.

A humidity sensing arrangement 42 is formed by passage 44 and a humidity sensing box 46 for actively evaluating the humidity within the cooking cavity. In one implementation, the humidity sensing arrangement may be formed by the two temperature probe system described and claimed in U.S. Pat. No. 7,875,834. In another implementation, the humidity sensing arrangement may be of the type shown in FIG. 2 where a humidity sensing chamber 46 includes a zirconium oxide sensor 48 (e.g., acting as a humidity sensor by means of inference—calculation based on Oxygen level). The system uses Dalton's law of partial pressures to determine humidity level. The partial pressure of an ideal gas in a mixture is equal to the pressure it would exert if it occupied the same volume alone at the same temperature. This is because ideal gas molecules are so far apart that they don't interfere with each other at all. As shown, the sensing chamber 46 may also include a heating arrangement 50 that acts to heat the chamber 46, so that the temperature within the chamber 46 can be be maintained at or above 212° F. during oven operation to avoid possibility of moisture condensation on the sensor 48. The illustrated arrangement also isolates sensor 48 from wash water and chemicals that may be used in the cooking cavity 14. The heater 50 would also be run during any wash cycle of the cavity 14. Other embodiments for humidity sensing, such as one in which the humidity sensor is located within the cavity 14 itself or one in which the humidity sensor is located in an exhaust path of the cooking cavity, are also possible.

Figure 3:
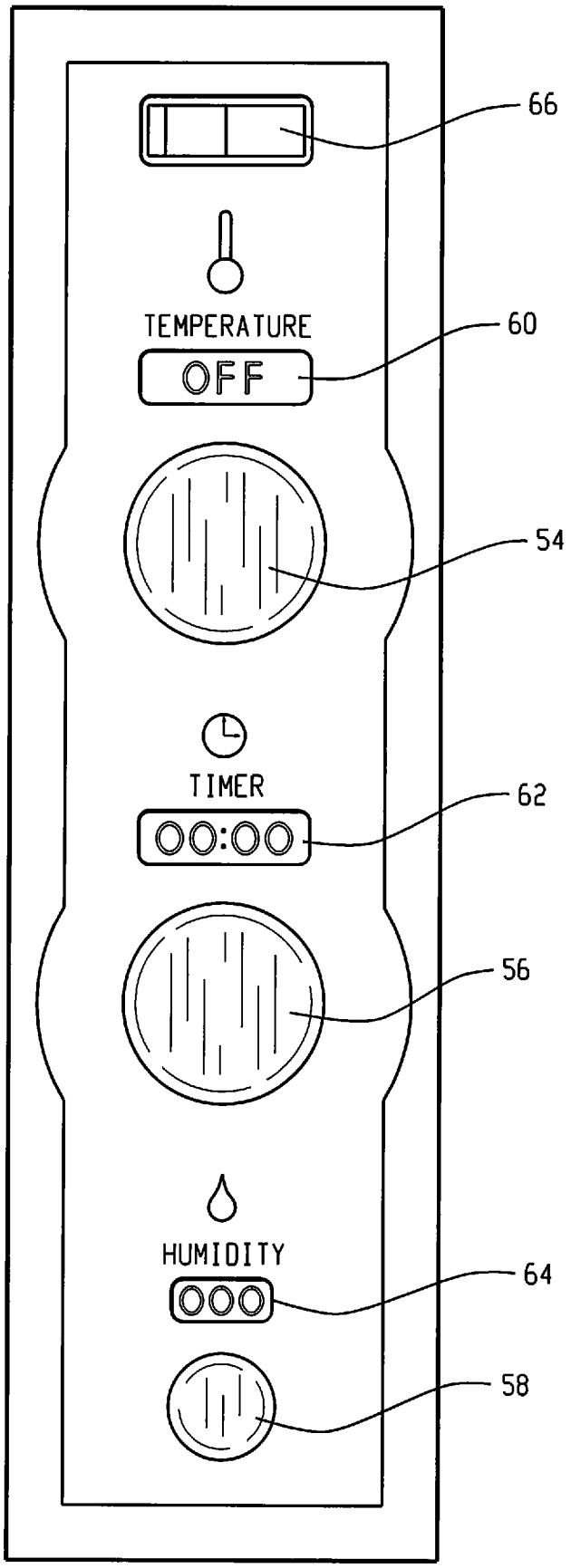
FIG. 3 is a schematic depiction of one embodiment of an oven control interface.

Referring again to FIG. 1, a controller 52 is programmed or otherwise configured to control oven operation (e.g., via connection to the various components). Although not shown in FIG. 1, the controller 52 would also include connections to control the operation of the convection cooking system components. The controller 52 enables a combination convection and steam cooking mode that advantageously makes it simple for the user to utilize the proper humidity setting. Specifically, the oven includes, for example, a control interface of the type shown in FIG. 3, where a temperature control knob 54, time control knob 56 and humidity control knob 58 are shown. In each case, as an alternative to the knobs, touch-type controls could be provided. A temperature display 60, time display 62 and humidity display 64 are also provided, along with an ON/OFF rocker switch 66. The various knobs, switches and displays are connected with the controller 52 of FIG. 1.

The controller 52 is programmed or otherwise configured such that when an operator selects an oven temperature for a manual cooking operation using the knob 54, a default humidity level setting is automatically defined by the controller 52 as a function of the selected temperature. The automatically defined humidity level is displayed on the display 62. As used herein, automatically defining or establishing a humidity level setting "as a function of" the selected temperature setting means that variances in the selected temperature will produce variances in the automatically defined or established humidity level setting, notwithstanding the fact that a number of different temperatures may result in the same humidity level setting. By way of example, some calculation, programmed rule or look-up table could be used by the controller to automatically define the humidity level setting as function of the selected temperature.

Figure 5:
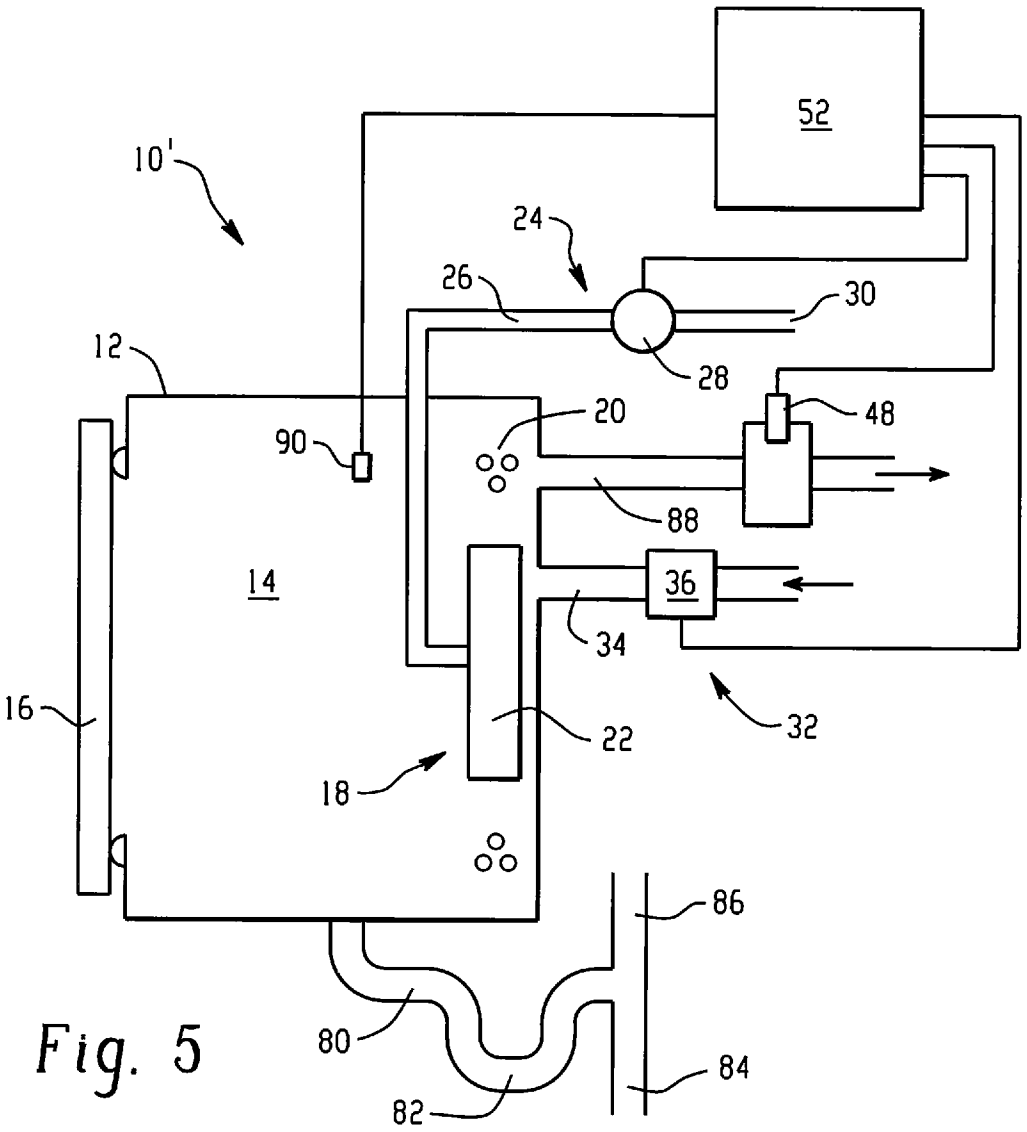
FIG. 5 is a schematic showing an alternative combination oven embodiment.

Referring now to FIG. 5, a schematic of an alternative oven embodiment 10' is shown, where the vent intake and exhaust arrangement 32 is formed by passage 34 and vent intake mechanism 36 in the rear wall of the oven for delivering air into the cooking cavity 14 and exhaust path 88, also in the rear wall of the oven, for delivering air out of the cavity 14. The humidity sensor 48 is located along the exhaust path 88. An exhaust mechanism could be located along the path 88. The oven drain path 80 includes a drain trap 82 that ultimately delivers draining liquids to a drain outlet path 84 having an associated drain vent 86. Although not shown in FIG. 1, the drain path of the FIG. 1 embodiment could include a similar trap and drain vent. In FIG. 5, multiple heating source members 20 are shown.

In the case of either oven embodiment, or in other possible embodiments, by controlling the convection cooking system 18 (e.g., fan and heater operation), moisture delivery arrangement 24 (e.g., when and how much water to deliver) and vent intake and exhaust arrangement 32 (e.g., when and how much air to exhaust from the cavity), the controller 52 is able to maintain the temperature and the humidity level settings during the cooking operation. As reflected by FIG. 4, the controller 52 may include memory with a stored temperature-humidity profile 70 (e.g., as a table or any other suitable format) that defines the default humidity level settings for the selectable temperatures. This default humidity level arrangement works well because, as suggested in Table 1 below, certain temperatures tend to be used for specific types of cooking/heating operations, and the appropriate humidity level setting for each type of cooking/heating operation can be determined by testing or other means.

TABLE 1

Cooking Operation Temperature And Desired Humidity

| Cooking Operation | Temperature (° F.) | Humidity (%) |
|---|---|---|
| Baking | 325 | 10 |
| Grilling | 375 | 0 |
| Roasting | 275 | 30 |
| Steaming | 212 | 100 |
| Proofing | 90 | 70 |
| Rethermalization | 250 | 40 |
| Low-Temp | 250 | 50 |
| Healthy-Fry | 375 | 10 |
| Delta-T | 350 | 50 |
| Finishing | 450 | 0 |
| Poaching | 185 | 100 |
| Stewing | 200 | 90 |
| Defrosting | 90 | 60 |

Figure 4:
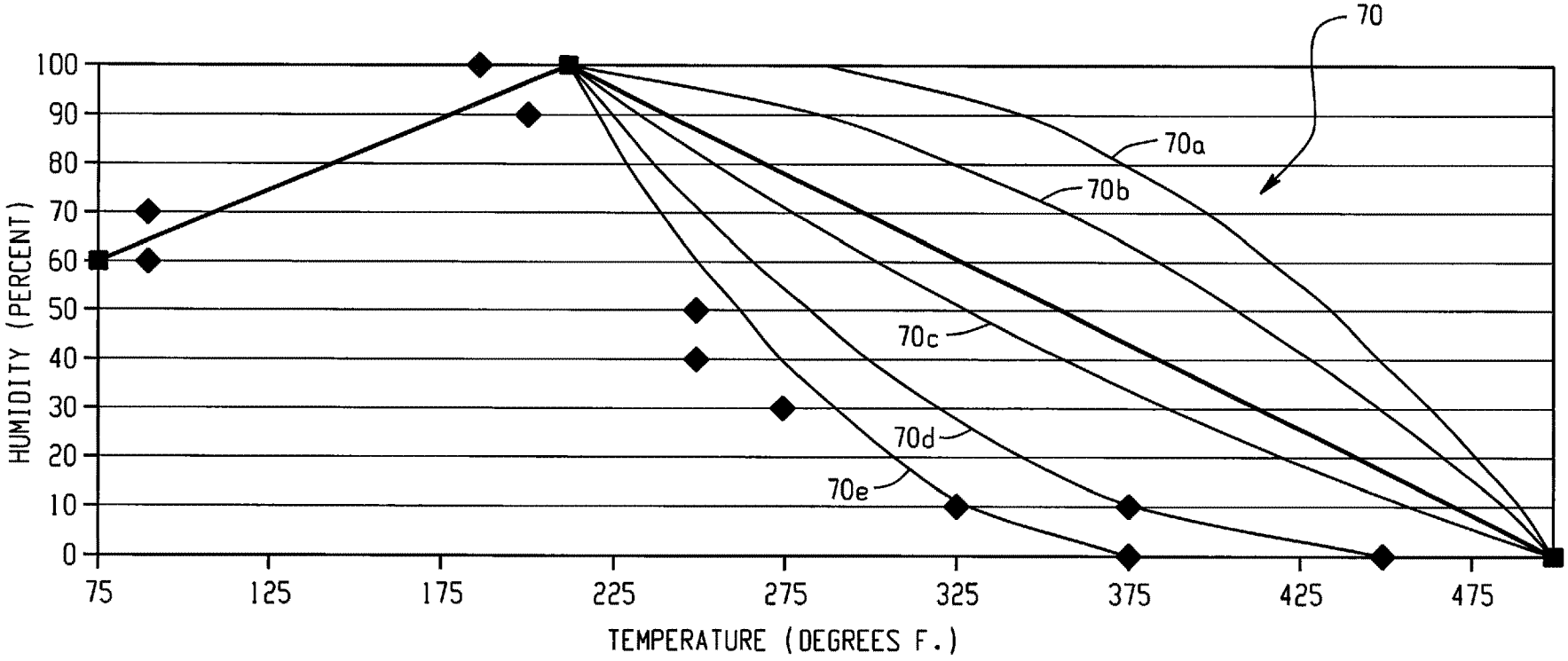
FIG. 4 is a graph showing exemplary temperature-humidity profiles.

The ideal temperature-humidity profile may be non-linear in nature, but can be simplified to a straight-line profile per FIG. 4. As suggested in Table 1 above, steaming operations are typically performed at 212° F. and 100% humidity. At temperatures below the 212° F. setting the default humidity level generally drops and at temperatures above the 212° F. setting the default humidity level generally drops.

In certain instances it may be desirable to work with specific oven operators to determine the operator's preferred, desired humidity level settings for different temperature settings, so that the temperature-humidity profile programmed into the controller 52 may be set accordingly. In another arrangement, the controller may store multiple possible temperature-humidity profiles (e.g., 70*a*, 70*b*, 70*c*, 70*d* and 70*d*), and the controller 52 may include a feature enabling one of the profiles to be selected as the active profile (e.g., by service personnel or, in some instances even via the user control interface, such as in a supervisor mode of the oven).

The operator can, if desired, change the humidity level setting so as to vary it from the automatically defined setting using the control knob 58. However, the controller 52 could be implemented with a lock-out feature (e.g., selectable in a supervisor mode) by which this manual adjust could be prevented.

General Operation

In one embodiment, the controller 52 and interface may be configured to operate in accordance with the following description. The ON/OFF rocker switch 66 (when switched off) shuts off all heat, cavity fan and water injection for humidity, but the oven will still have power to the boards (e.g., the controller 52). When the oven is turned on by the ON/OFF switch 66, the unit will power up and display last settings for each of the displays. The oven may begin heating and fan operation immediately according to the recalled last temperature.

If there are no recall settings available (e.g., after a power outage), the temperature will default to "---" which deactivates the heating, fan and water injection, but all displays may be lit. Time will default to "--:--" and humidity will default to "---". When the temperature knob 54 is adjusted the unit will operate based on parameter settings for temperature, time and humidity. If temp display is "---", there may still be functionality in the time knob as an egg shell timer by itself. When the unit is powered off by rocker switch 66 the temperature display 60 will blink for 3 seconds "CLn". Concurrently, the time display 62 will show "good" and humidity will show "bye" without flashing. "CLn" may act as an indication to clean unit and is a reminder for the operator. After 3 seconds all displays will go blank.

Rotating the temperature knob 54 clockwise will increase temperature based on parameter settings (e.g., in increments of 1°, 5° or 25°). Rotating the temperature knob 54 counterclockwise will decrease temperature based on parameter settings. Rotating the temperature knob 54 counterclockwise will decrease temperature until it reaches a lowest possible temperature, then one more turn will cause the temperature display 60 to display standby (idle) mode, which may be displayed as "---". A set temperature occurs when the temperature knob 54 is adjusted and stops, the temperature display 60 numbers will blink for 3 seconds then remain solid (stop blinking) which indicates the temperature has been set. Heating then begins based on the set temperature. Turning the temperature dial one indent to the right or left, when the oven is displaying a set temperature, will show the actual oven cavity temperature, not the set temperature. The actual temperature may be shown for 3 seconds, then the display 60 may blink the set temperature again for 3 seconds before going solid.

When the unit is first powered on, the time display will be "--:--". To increase or decrease the time, the knob 56 is rotated clockwise or counterclockwise. When the knob 56 stops rotating, the display 62 numbers will blink for 3 seconds then remain solid (stop blinking) which indicates the time has been set. Time then begins to countdown for the cooking operation. Once time is actively counting down it will finish at 00:00 and the controller may alert the operator with buzzer and/or lights (based on parameter settings). To add time at this point, the operator adjusts the knob 56 to the desired additional time (the buzzer and/or lights will stop when additional time is added). To mute the buzzer function the operator may rotate the time knob to the left when door is shut. Lights and display may still flash in this case. Additionally, the operator can open the door 16 to stop the time/buzzer. Upon shutting the door 16, the time function resets to last start point (recalls last setting). If the door 16 was opened during active time countdown, the time pauses and restarts when door is shut. At the end of a time cycle "00:00" flashes. If no adjustments of the time knob are made and "00:00" is still displayed after a set time period when the door is shut, the last time setting will automatically be recalled and a time countdown again started. To manually achieve no time setting, the operator adjusts the time knob 56 counterclockwise until "--:--" is displayed. In one embodiment, the time function does not control or affect the heating or humidity functions. Setting the time may work the same when door 16 is either open or closed. However, time does not count down when door is open.

As mentioned above, the humidity setting is controlled by default settings tied to temperature (adjustable in parameters), unless the operator adjusts the knob 58 manually. Once the temperature is set, the default humidity is correspondingly set and displayed, and the cooking operation will proceed with such setting. To increase or decrease the humidity setting manually, the operator adjusts the knob 58 clockwise or counterclockwise. When the knob 58 stops turning the display 64 numbers will blink for 3 seconds then remain solid (stop blinking), which indicates humidity has been manually set. Turning the humidity knob 58 one indent when the oven is displaying a set humidity will show actual humidity, not the set humidity. The actual humidity may be shown for 3 seconds, then the display 64 may blink the set humidity again for 3 seconds before going solid. Recall of the last humidity setting is also done when temperature is switched "OFF" then back on to last temperature.

The controller and oven control interface may be configured such that an operator can only set or select temperature, humidity level and duration for a cooking operation and the operator can only define a single stage cooking operation. That is, cooking recipes (i.e., multiple stages with multiple corresponding temperatures, durations and humidities) cannot be selected to be carried out in a single cooking operation. This configuration provides very straightforward operation in that the only thing an operator needs to do is set the temperature and time.

Selection of Active Humidity Profile

As mentioned above, multiple default temperature-humidity profiles may be stored in controller memory, with only one of the profiles being active at any one time. In one embodiment, the active profile may be set at the factory, and thereafter remain fixed. In another embodiment, the controller 52 may include a profile selection mode that enables the active profile to be varied. Typically, the profile selection mode may be a supervisor only mode or a service person only mode, such that lower level kitchen personnel cannot change the active profile. In this regard, in one implementation, in order to enter the supervisor or service mode, the knobs are adjusted in a specific manner (e.g., like an access code or combination) that initiates the supervisor or service mode. One or more of the displays 60, 62 and 64 displays information to indicate that the supervisor/service mode is active. At that point, one of the knobs (e.g., the temperature knob 54) may be used to define a parameter that will be changed. For example, parameters P00 through P49 may exist that can be changed in the supervisor mode, with, for example, parameter P10 representing a profile selection mode that offers the ability to select one of a number of stored temperature-humidity profiles to be the active profile. In such a case, the time knob would be rotate until P10 is displayed solid in the temperature display 60. At that point, the humidity knob 58 could be rotated to select the desired temperature-humidity profile. For example, if there are 10 stored profiles (e.g., PR1, PR2, PR3 etc), the knob 58 is rotated to select one of them. When the desired profile number is displayed in display 64 as solid, it has been set to the new active profile. The service mode may be exited by, for example, rotating the temperature knob counterclockwise until "---" is displayed.

Temperature Customization

In certain cooking environments it may be desirable to limit the number of temperatures available to cooking personnel for cooking operations. For example, in a cooking environment where a combi oven is only going to be used to perform 5 different possible cooking operations, then limiting the selectable temperatures to five corresponding cooking temperatures may make sense. The supervisor mode may permit the controller 52 to be configured with such limitations. In particular, once the supervisor mode is activated via the interface (e.g., as described above), a temperature customization mode may be initiated by selecting, for example, parameter P05. Activation of custom temperature setting begins with default "ALL" shown in time display 62 and "On" shown in humidity display 64. This default "ALL On" setting means all temperatures of the active profile will be displayed in time display 62 and can individually be deactivated. The default "ALL On" setting can also be turned off so that only temperatures selected "On" from the list will be displayed. In order to do so, while "ALL" is shown on time display 62, the supervisor changes "On" to "OFF" on humidity display 64 using knob 58. All temperatures are OFF at this point. Should someone mistakenly exit without turning on a temperature, the unit will default & error back to "All On" (or last known "On" settings). To turn "On" any given temperature, the time knob 56 is rotated until display 62 displays the given temperature and the humidity knob 58 is adjusted to read "On" for that temperature. Saving and flash display sequence occurs after each humidity knob change setting occurs. Thus, specific, discrete temperatures can be activated individually, with humidity for each temperature turned ON (i.e., the humidity in the profile will be active) or OFF (i.e., the humidity in the profile will not be active). Regardless of whether the humidity is active, once the supervisor mode is exited, in subsequent cooking operations only those discrete temperatures that have been set active can be selected by the operator for cooking operations.

In a more advanced temperature customization mode, the humidity level setting for each active temperature can be modified as opposed to just being selectable for default ON or OFF. Once the supervisor mode is activated via the interface (e.g., as described above), a temperature and humidity customization mode may be initiated by selecting, for example, parameter P06. Temperatures will only be shown in time display based on active temperature settings. Once a temperature is displayed in time display 62, the humidity display 64 will display the default humidity setting (e.g., 70%). The humidity knob 58 is then rotated to adjust the humidity setting for the displayed temperature, and the adjusted humidity setting will activate a saving and flash display sequence (e.g., one the humidity setting has adjustment has stopped (e.g., for 3 seconds)). The humidity setting for each active temperature can be adjusted in the same manner if desired, and such settings can depart from the settings in any of the stored default temperature-humidity profiles.

Automatic Venting Operation

The oven may also include an automatic cavity venting operation that is initiated at the end of the cooking operation by (i) controlling the moisture delivery arrangement 24 of the oven to cease addition of moisture to the cooking cavity 14 and (ii) turning on the vent intake and exhaust arrangement 32 of the oven to exhaust moist air from the cavity while drawing in ambient air. The automatic vent operation reduces the humidity in the cavity 14 in preparation for an operator opening the cavity door 16.

In one embodiment, the vent operation is initiated with a preset duration that occurs immediately upon the timer count down reaching "00:00." In another embodiment, the vent operation has a preset duration that is initiated for the very last part of the set time duration (e.g., if the preset vent duration is 30 seconds, then the cavity vent operation is initiated when the timer reaches "00:30"). In still another embodiment, the vent operation has a preset duration that is initiated shortly before the very last part of the set time duration (e.g., if the preset vent duration is 30 seconds, then the cavity vent operation is initiated when the timer reaches "00:40" and when the timer reaches "00:10" the vent operation is stopped. In any of the foregoing cases, the vent operation is deemed initiated "at the end of the cooking operation." Likewise, in a more advanced oven arrangement that includes a cook to temperature feature, the oven may include a food temperature probe 90 (e.g., see FIG. 5) that is used by the controller 52 to determine the end of the cooking operation (e.g., where the oven is set to cook a pork roast to a desired temperature, such as 145° F.). In this case, the vent operation may be automatically initiated when the desired food product temperature is reached. Again, such an operation would be deemed to be initiated "at the end of the cooking operation."

In a more advanced system, the duration of the cavity vent operation may be established as a function of the temperature and/or humidity setting of the cooking operation being carried out. For example, the controller 52 could be programmed to calculate the duration of the cavity vent operation based upon set time and set temperature, or a stored table could be provided for such purpose.

In one embodiment, the cavity vent operation may be set to be initiated only in cases where the humidity setting is greater than X % (e.g., a X % humidity setting or lower deactivates any possible cavity vent operation or a X % humidity level or lower automatically results in a calculated cavity vent operation of 0 seconds). By way of example, X % might be 0% or some higher level, such as 20%, with other variations possible.

The supervisor mode may be used to activate or deactivate the cavity vent operation for manual cooking operations. When activated, the cavity vent operation will automatically be carried out as necessary. When deactivated, the cavity vent operation will not be carried out.

It is to be clearly understood that the above description is intended by way of illustration and example only, is not intended to be taken by way of limitation, and that other changes and modifications are possible.

The invention claimed is:

1. A combination oven, comprising:

a cooking cavity accessible via a door;

a convection cooking system associated with the cooking cavity for heating the cooking cavity;

a moisture delivery arrangement for delivering moisture into the cooking cavity;

a controller configured to (i) automatically adjust and define a humidity level setting for a cooking operation based only on operator adjustment and selection of a numerical temperature setting for the cooking operation using a temperature control input of the oven and (ii) initiate the cooking operation and control both the convection cooking system to achieve the selected numerical temperature setting and the moisture delivery arrangement to achieve the defined humidity level setting;

an oven control interface including:

the temperature control input;

a display for displaying the selected numerical temperature setting;

a display for displaying the automatically defined humidity level setting tor the cooking operation;

an input for manually adjusting humidity level to permit operator variance of the defined humidity level setting;

an input for selecting duration for the cooking operation;

wherein the controller and oven control interface are configured such that an operator can only set or select numerical temperature, humidity level and duration for a cooking operation and the operator can only define a single stage cooking operation;

wherein the controller includes associated memory storing at least one temperature-humidity profile that is accessed, based only on the selected numerical temperature setting, to define the humidity level setting, wherein the controller utilizes the selected numerical temperature setting to access the temperature-humidity profile and retrieve a corresponding humidity level setting.

2. The combination oven of claim 1, further comprising:

a vent intake and exhaust arrangement for exhausting air from the cooking cavity while drawing in ambient air;

wherein the controller is programmed to control the vent intake and exhaust arrangement, in combination with the moisture delivery intake arrangement, to achieve the defined humidity level setting in the cooking cavity during the cooking operation.

3. The combination oven of claim 1, further comprising:

a humidity level monitoring arrangement associated with the cooking cavity for determining humidity level within the cooking cavity, the humidity level monitoring arrangement including at least one sensor operatively connected with the controller.

4. The combination oven of claim 1 wherein multiple temperature-humidity profiles are stored in memory, the controller programmed to enable one of the temperature-humidity profiles to be selected as an active temperature-humidity profile that will be accessed for the purpose of defining the humidity level setting.

5. The combination oven of claim 1, further comprising:

a vent intake and exhaust arrangement for exhausting air from the cooking cavity while drawing in ambient air;

wherein the controller is configured to automatically carry out a cavity vent operation at the end of the selected duration of the cooking operation, the controller configured such that during the cavity vent operation the controller will (i) control the moisture delivery arrangement to cease addition of steam or moisture and (ii) turn on the vent intake and exhaust arrangement.

6. The combination oven of claim 5 wherein the controller is configured such that a duration of the cavity vent operation is automatically set by the controller according to the numerical temperature setting and/or humidity level setting of the cooking operation such that variances in numerical temperature setting or humidity level settings potentially result in variances in duration of the cavity vent operation.

7. The combination oven of claim 1, wherein the controller is configured with a customize mode in which discrete numerical temperatures may be identified and stored for future use in cooking operations, such that once the discrete numerical temperatures are identified and stored, in a subsequent cooking mode only the identified and stored numerical temperatures can be selected by the operator for cooking operations.

8. A method of cooking a food product using a combination oven having a cooking cavity accessible via a door, a convection cooking system associated with the cooking cavity for heating the cooking cavity and a moisture delivery arrangement for delivering moisture into the cooking cavity, the method comprising:

an operator using a temperature control input device to adjust and select a numerical temperature setting for a cooking operation; and a controller of the oven automatically adjusting and defining a percent humidity level setting for the cooking operation based only on the operator adjusting and selecting the numerical temperature setting and without the operator adjusting or selecting any of a cooking mode, cooking duration, humidity parameter or moisture level parameter, wherein the controller of the oven automatically varies both (i) a displayed numerical temperature setting responsive to the operator using the temperature control input device to adjust and select the numerical temperature setting for the cooking operation and (ii) a displayed percent humidity level setting responsive to the operator using the temperature control input device to adjust and select the numerical temperature setting for the cooking operation.

9. The method of claim 8 wherein the percent humidity level setting is automatically defined by reference to a stored temperature-humidity profile, wherein the controller utilizes only the numerical temperature setting to access the temperature-humidity profile and retrieve a corresponding percent humidity level setting.

10. The method of claim 9, including the further step of providing multiple stored temperature-humidity profiles and enabling selection of an active one of the stored temperature-humidity profiles.

11. The method of claim 9, wherein the controller is configured such that only a discrete number of numerical temperature options are made available for operator selection for the cooking operation.

12. The method of claim 8, comprising the further step of:

automatically carrying out a cavity vent operation at the end of the cooking operation by (i) controlling a moisture delivery arrangement of the oven to cease addition of moisture to the cooking cavity and (ii) turning on a vent intake and exhaust arrangement of the oven to exhaust moist air from the cavity while drawing in ambient air.

13. A combination oven, comprising:

a cooking cavity accessible via a door;

a convection cooking system associated with the cooking cavity for heating the cooking cavity;

a moisture delivery arrangement for delivering moisture into the cooking cavity;

a controller configured to (i) automatically retrieve from memory a percent humidity level setting for a cooking operation based only on an operator selected temperature for the cooking operation and (ii) control both the convection cooking system to achieve the operated selected temperature and the moisture delivery arrangement to achieve foe retrieved percent humidity level setting during foe cooking operation.

14. The combination oven of claim 13, further comprising a temperature display for displaying the operated selected temperature and a humidity display for displaying the automatically retrieved percent humidity level setting, and the controller is configured such that as the operator varies selected temperature (a) the temperature display is correspondingly and automatically varied and (b) the humidity display is automatically varied to reflect adjustments in corresponding retrieved percent humidity level setting.

15. A combination oven, comprising:

a cooking cavity accessible via a door;

a convection cooking system associated with the cooking cavity for healing the cooking cavity;

a moisture delivery arrangement for delivering moisture into the cooking cavity;

a temperature control input for enabling an operator to select a specific degree temperature setting to be used for a cooking operation without selecting other cooking operation settings; and a controller configured to (i) automatically define a specific percent humidity level setting to be used for the cooking operation in response to and based only on the operator selected specific degree temperature setting for the cooking operation and (ii) control both the convection cooking system and the moisture delivery arrangement during the cooking operation to achieve both the operator selected specific degree temperature setting and the automatically defined specific percent humidity level setting.

* * * * *